United States Patent [19]

Downing

[11] 4,195,428

[45] Apr. 1, 1980

[54] STEAM IRON WATER GAUGE

[75] Inventor: Arthur C. Downing, Ontario, Calif.

[73] Assignee: General Electric Company, New York, N.Y.

[21] Appl. No.: 958,032

[22] Filed: Nov. 6, 1978

[51] Int. Cl.[2] ..... D06F 75/06

[52] U.S. Cl. ..... 38/77.2

[58] Field of Search ..... 38/77.2, 74, 77.8, 94, 38/88; 73/290 R, 323, 334; 116/227, 276

[56] References Cited

U.S. PATENT DOCUMENTS

| | | | |
|---|---|---|---|
| 1,068,626 | 7/1913 | Buck | 38/77.2 |
| 3,075,309 | 1/1963 | Seyfried et al. | 38/77.2 |
| 3,193,954 | 7/1965 | Robison | 38/77.2 |
| 3,251,148 | 5/1966 | Knapp | 38/77.2 |
| 3,298,118 | 1/1967 | Vieceli | 38/77.2 |
| 3,298,119 | 1/1967 | Vieceli | 38/77.2 |
| 3,903,625 | 9/1975 | Augustine | 38/77.2 |
| 4,021,943 | 5/1977 | McMullen | 38/77.2 |
| 4,031,638 | 6/1977 | Ryckman | 38/77.2 |

*Primary Examiner*—Louis Rimrodt

*Attorney, Agent, or Firm*—John F. Cullen; George R. Powers; Leonard J. Platt

[57] ABSTRACT

In a lightweight steam iron with a soleplate and means to selectively deliver water for steam distribution and having a first plastic plate above the soleplate coextensive therewith and a skirt portion around the plastic plate with a second plastic housing having a handle and sealingly supported by the plate whereby the skirt and housing form internal water tank walls and also enclose other iron operating components. A water gauge is supplied for the iron and an improvement on the gauge in this combination includes an entirely integral elongated rectangular niche or cut-out with back, bottom and sides, so the niche forms one of the housing edges parallel to the handle. The niche has spaced apertures in its back side facing outwardly of the iron and connecting with the interior of the tank top. Disposed in the niche is an enclosed integral blow-molded rectangular translucent tubular gauge that is made of the same basic material as the housing material and is nested in the niche against all sides to complete the edge for a symmetrical outer housing surface. The gauge has spaced integrally formed tubes projecting from one side and aligned with the apertures to extend into the tank whereby they are secured such as by heat staking inside the tank to lock the gauge to the housing. The materials are preferably polypropylene and the simple construction forms an integral one-piece water gauge that requires no seals or mastics and the gauge itself is preferably transparent to provide high water level visibility when the iron is either flat or in its vertical storing position.

4 Claims, 4 Drawing Figures

STEAM IRON WATER GAUGE

BACKGROUND OF THE INVENTION

1. Field of the Invention

This invention relates to lightweight steam irons, and, more particularly, plastic irons with an improved water gauge structure comprising a blow-molded tubular gauge nesting in the housing to form a one-piece highly visible gauge for the iron in flat or vertical position.

2. Description of the Prior Art

It is common practice to provide steam irons with some form of water level gauge for visual observance of the water level during ironing. Various types of gauges are used to monitor the water level, some indicating the level only when the iron is in a vertical or filling position and others indicating the level only when the iron is in a horizontal ironing position and some indicating water level in both positions. Such gauges have been somewhat complex structure using tubes or relatively large openings in the side walls of the iron and generally requiring numerous small pieces that must be accurately fitted during assembly.

SUMMARY OF THE INVENTION

An object of the present invention is to provide, in a lightweight plastic steam iron, an improved water gauge that smoothly nests in an iron housing to complete its symmetry and is easily assembled.

Another object is to provide a simple water gauge construction that indicates water level in either vertical or flat iron position and uses newer structure and techniques employing plastics.

A further object is to provide such an improved water gauge in a lightweight plastic iron wherein the gauge is made of the same material as the iron permitting easy assembly without the need for seals or mastics and having high water level visibility in all positions of the iron.

Briefly stated, a lightweight plastic steam iron having a soleplate and means to selectively deliver water for steam distribution has a first plastic plate coextensive with and above the soleplate to form a skirt portion around the soleplate. A second plastic housing with an integrally formed handle is sealingly supported by the plate, and the skirt and housing form internal water tank walls and also enclose other iron operating components. An improved water gauge is provided in this combination comprising an entirely integral elongated substantially rectangular niche that has back, bottom and end sides to form part of the housing edge parallel to the handle, similar to a square cut-out in the housing edge. Spaced apertures in the back side of the niche connect the interior top of the water tank and face outwardly of the iron body. Fitting snugly in the niche is a completely enclosed blow-molded rectangular translucent tubular gauge made of the same basic material as the housing such as polypropylene, with the gauge nested in the niche against all sides to complete the edge of the housing for a symmetrical outer housing surface. Connecting the interior of the gauge are plural, preferably a pair of, spaced integrally-formed tubes that are aligned with the apertures in and project from the gauge and extend through the apertures into the tank. The tubes are secured inside the tank such as by heat staking them to the tank inner surface to securely lock the gauge to the housing in a leak-proof manner. Thus, the main object of the invention is to provide an iron of plastic construction with a unique, easily assembled water gauge of an integral one-piece gauge that requires no seals, or mastics, that is easily assembled, and that provides high water level visibility when the iron is either in flat or vertical heel-rest position.

DESCRIPTION OF THE PREFERRED EMBODIMENT

Figure 1:
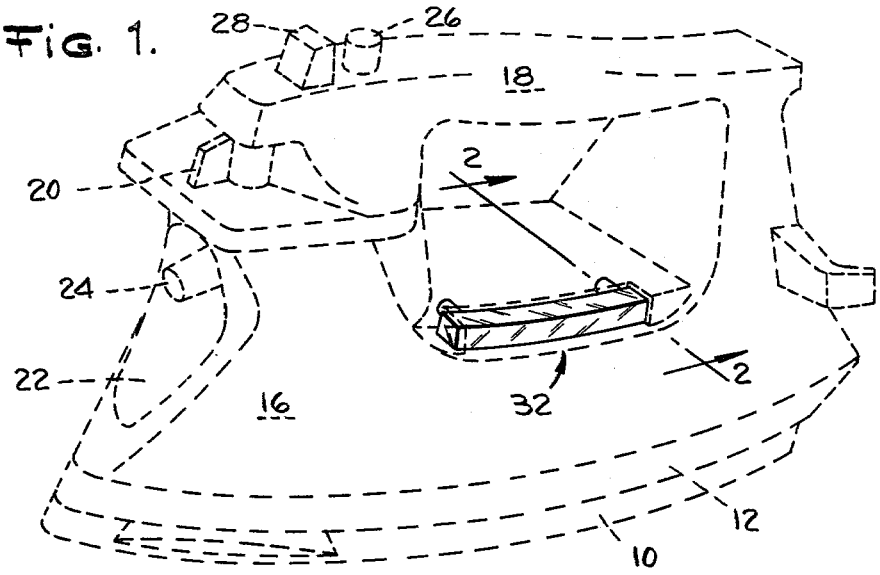
FIG. 1 is a dotted perspective view of a steam iron incorporating the present invention shown in solid lines.

The invention is described in connection with a lightweight steam iron that uses a conventional aluminum soleplate, such as shown in U.S. Pat. No. 4,031,638 of common assignment, which is attached by suitable means to plastic skirt and housing portions, the upper portion of the iron being all plastic and formed to provide an internal water tank. Referring first to FIG. 1, there is shown an electric steam iron that includes a soleplate 10 with a plurality of ports not shown to distribute steam through the soleplate for steaming fabrics while ironing in the conventional manner. The iron is provided with a first plastic plate 12 above the soleplate and coextensive with the soleplate to form a skirt portion around the soleplate being spaced from the soleplate and supported thereon by conventional structure to provide an opening 14 for circulation of air. Because of the proximity to the heated soleplate, plate 12 may be a phenolic to resist the heat. Directly above the plate 12 and secured thereto in any conventional manner and preferably sealed at 15 is a second plastic housing 16 which has an enclosed or open handle 18 that is preferably molded as part of the housing. Conventionally, the soleplate 10 is generally a material such as cast aluminum with an electrical heating element cast in the soleplate and secured thereto and which is controlled by a thermostat knob means 20 suitably calibrated for the common fabrics and with the iron operable through a cord not shown all well known in the art. The iron is filled with water through an opening in recess 22 and may have a spray nozzle 24 or alternatively, may have extra surge capacity, either operable by button 26 and the iron is operable dry or steaming depending on the position of control knob 28, which when in the up position as shown, permits water from an internal reservoir or tank 30 to selectively drip and deliver water into a boiler cavity for generation and subsequent distribution of steam all as well known. For storing, the iron can be tilted to its heel rest postion where a suitable support means provides stability. As described, the iron uses two main plastic components such as plate 12 with its skirt portion and housing 16 which, when sealed together at 15 provide walls for an internal water tank 30 and the housing and plate also enclose other internal iron operating components. To this general combination, there is provided a water gauge generally indicated at 32 which is the improvement disclosed herein.

Figure 2:
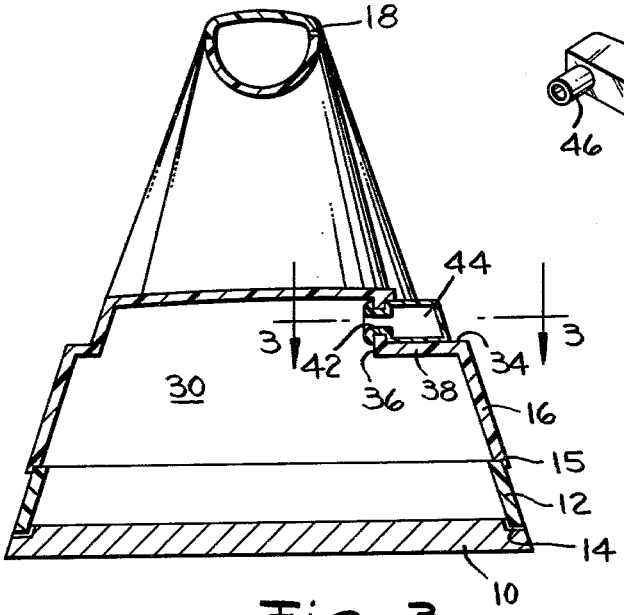
FIG. 2 is a cross-section on line 2—2 of FIG. 1.
Figure 4:
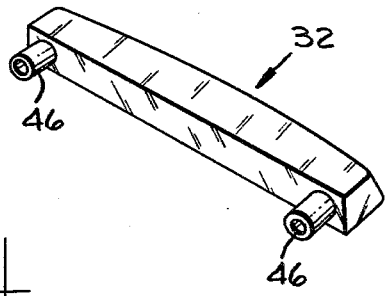
FIG. 4 is a perspective of the integral blow-molded tubular gauge.
Figure 3:
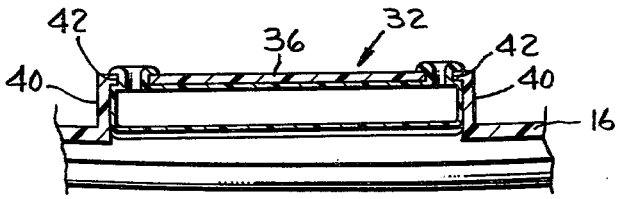
FIG. 3 is a cross-section on line 3—3 of FIG. 2.

In accordance with the invention, a gauge improvement is obtained by providing an entirely integral elongated rectangular niche 34 that is formed in the upper edge of housing 16 and extends parallel to handle 18. This is the general conventional location of many tubular water level gauges in prior art irons. Because of the molded and formed plastic construction, elongated niche 34 is rectangular in cross-section, substantially square as shown, and has back side 36, bottom side 38, and opposite end sides 40 formed to snugly nest and accommodate water gauge 32 as will become apparent. For connecting with the internal water tank 30, there is provided spaced, (preferably a pair) apertures 42 formed directly in the back side 36 and facing outwardly of the iron body formed by housing 16. Thus, communication between the niche and the top of the internal tank 30 is provided. Cooperating with the niche in a tight snugly nested arrangement is a separate integral blow-molded correspondingly shaped, such as rectangular, translucent tubular gauge 32 that fits in the niche tightly against all three sides 36, 38, and 40 being formed to complete the edge of housing 16 for a symmetrical outer housing surface as shown in FIG. 2. Preferably, gauge 32 is transparent and is made of the same material as housing 16, conveniently polypropylene, to avoid sealing problems as explained below. Water gauge 32 is a blow-molded plastic tubing that has a hollow portion 44 to receive water for visibility as a gauge. As a blow-molded structure there are provided integrally formed, preferably a pair, of spaced tubes 46 at each end of the gauge to project from the gauge as shown in FIG. 4. The tubes are formed long enough to extend and open into the tank 30 to communicate with the interior of the tank at its top.

Because the housing 16 and water gauge 32 are both made of the same plastic material, their coefficients of expansion are identical and a structure that does not require any seals or mastic is possible. A watertight fitting between the tubes and back side 36 is provided by spreading the tubes on the interior of back wall 36 by a simple heat staking operation. This provides a tight fit between the gauge 32 and housing 16 and a watertight connection that holds the gauge in position without any mastics or sealing compound being required.

The present invention thus provides a water gauge improvemnt applicable to plastic iron construction wherein a single integrally formed blow-molded translucent tubular gauge is simply formed, aesthetically fitting into the iron, easily assembled with no extra parts on the assembly line, has high visibility in both horizontal ironing and vertical storage position and provides an inexpensive single-piece construction over the multipieces tubular construction heretofore on irons.

While I have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. A lightweight steam iron having a soleplate and means to selectively deliver water for steam distribution therefrom with a first plastic plate above the soleplate coextensive therewith and having a skirt portion therearound, a second plastic housing with a handle and sealingly supported by said plate, the skirt and housing forming water tank walls and enclosing operating components, and a water gauge for said tank, a gauge improvement comprising, an entirely integral elongated rectangular niche with back, bottom, and end sides forming a housing edge parallel to the handle.

spaced apertures in the back side connecting the interior tank top, said apertures facing outwardly of the iron body formed by the housing, an enclosed blow-molded rectangular translucent integral tubular gauge of housing material nested in said niche against all sides completing the edge for a symmetrical outer housing surface, spaced integrally-formed aperture-aligned tubes projecting from the gauge, said tubes extending and opening into said tank through said apertures, and means securing the tubes inside said tank to lock the gauge to said housing and form an integral one-piece water gauge without seals or mastics for high water level visibility with the iron flat and vertical.

2. Apparatus as described in claim 1 wherein said tubes comprise a pair of tubes, one substantially at each end of the elongated blow-molded gauge, and said apertures comprise a pair spaced equally with said tubes.

3. Apparatus as described in claim 2 wherein said plastic tubes are secured by heat staking to the similar material housing wall interior forming a water tight fitting between the tubes and wall.

4. Apparatus as described in claim 3 wherein said housing, gauge, and integral tubes are all polypropylene.

* * * * *